US007533836B2

(12) United States Patent
Pan

(10) Patent No.: US 7,533,836 B2
(45) Date of Patent: May 19, 2009

(54) SPLASH GUARD FOR A GARBAGE DISPOSAL UNIT

(75) Inventor: Ji Cheng Pan, Shenzhen (CN)

(73) Assignee: Johnson Electric S.A., La Chaux-de-Fonds (CH)

( * ) Notice: Subject to any disclaimer, the term of this patent is extended or adjusted under 35 U.S.C. 154(b) by 321 days.

(21) Appl. No.: 11/646,329

(22) Filed: Dec. 28, 2006

(65) Prior Publication Data

US 2007/0152087 A1 Jul. 5, 2007

(30) Foreign Application Priority Data

Dec. 30, 2005 (CN) ..... 2005 1 0137586

(51) Int. Cl.
*B02C 23/36* (2006.01)

(52) U.S. Cl. ..... 241/46.016; 241/46.014

(58) Field of Classification Search ..... 241/46.013, 241/46.014, 46.016; 4/DIG. 4
See application file for complete search history.

(56) References Cited

U.S. PATENT DOCUMENTS

| | | | | |
|---|---|---|---|---|
| 2,948,482 | A * | 8/1960 | Jordan | 241/46.015 |
| 3,432,108 | A | 3/1969 | Enright | |
| 3,524,596 | A | 8/1970 | Smith | |
| 3,693,892 | A * | 9/1972 | Musa | 241/46.016 |
| 6,719,228 | B2 | 4/2004 | Berger et al. | |
| 2004/0195409 | A1 | 10/2004 | Berger et al. | |

FOREIGN PATENT DOCUMENTS

| | | | |
|---|---|---|---|
| GB | 2 392 636 | A | 3/2004 |
| JP | 2003-71311 | A | 3/2003 |
| JP | 2003-275611 | A | 9/2003 |

* cited by examiner

*Primary Examiner*—Bena Miller
(74) *Attorney, Agent, or Firm*—Birch, Stewart, Kolasch & Birch, LLP

(57) ABSTRACT

A splash guard for an under the sink garbage disposal unit has a baffle which prevents splash back. The baffle has a membrane with a number of radially extending slits. Each slit has a pair of walls extending downwardly from the membrane forming a channel. One wall of each pair of walls has a lateral ledge or laterally displaced axial end forming a bottom to the channel. The other wall of each pair of walls is shorter in height so as to leave a gap between the second wall and the ledge of the first wall, thus forming a lateral opening at the bottom of the channel. Thus the slits form passageways through the membrane without having direct or aligned openings.

14 Claims, 3 Drawing Sheets

SPLASH GUARD FOR A GARBAGE DISPOSAL UNIT

CROSS REFERENCE TO RELATED APPLICATIONS

This non-provisional application claims priority under 35USC119(a) from Chinese Patent Application Number CN200510137586.7 filed on 30 Dec. 2005.

FIELD OF THE INVENTION

This invention relates to a garbage disposal unit and in particular, to a splash guard therefor.

BACKGROUND OF THE INVENTION

A garbage disposal unit is installed under a kitchen sink and receives garbage or food waste disposed through the drain of the sink. The disposal unit comprises a grinding mechanism located within a working chamber which receives the garbage. Flowing water is recommended during operation of the disposal unit to aid movement of the garbage to and through the grinding mechanism. The violent nature of the grinding process means that the water may be splashed back out of the drain opening and sometimes solid items may be expelled as well. For this reason, most disposal units have a splash guard of some form to prevent back splash. However, due to the nature of the device, the splash guard must be able to accept or allow large items of garbage and copious volumes of water to pass down the drain with minimal interference. Most splash guards have a web or baffle made of rubber or similar material which spans across the drain. The baffle has a number of slits to allow segments of the baffle to easily yield to incoming items yet provide some resistance to splashed back items. Most include a central opening which remains open even when the baffle is closed to allow free draining of water. This central opening still allows some splash back as well as noise from the grinding process to escape unimpeded. Indeed, most baffle designs provide only a minimal resistance to splashed back items.

Modern attempts to improve on the slit design use an uncut design in which the baffle is pleated allowing the small central opening to expand easily with downward pressure but remaining small or even contract further with upward pressure. However, this design still has a clear central opening. Such a design is shown, for example, in U.S. Pat. Nos. 3,432,108 and 6,719,228, both of which are incorporated by reference in their entireties.

U.S. Pat. No. 6,719,228 shows an improved version in which the baffle is slit about a central hole, but smaller, direct holes are provides at the ends of the slits and additional holes are shown in preferred examples. For that application, an additional baffle is provided.

Thus, there is a need for a baffle for a garbage disposal unit which is simple yet prevents the back splash of water and/or garbage.

SUMMARY OF THE INVENTION

Accordingly, the present invention provides a splash guard for a garbage disposal unit, comprising a baffle and a support for the baffle, the baffle comprising: a membrane; a number of slits in the membrane, extending from a common point; a corresponding number of pairs of walls extending downwardly from a lower surface of the membrane, each pair of walls bounding the path of a respective slit and forming a channel therebetween; wherein a first wall of each pair of walls has an axial end displaced laterally towards the second wall of the pair of walls and forming a bottom to the respective channel, and the second wall of each pair of walls terminating before reaching the displaced axial end of the first wall thus forming a lateral opening at the bottom of the channel.

Preferably, the slits extend radially across the membrane, extend in curvilinear path across the membrane or extend in a semicircular path across the membrane.

Preferably, the axial ends of the first walls are smoothly displaced towards the respective second wall.

Alternatively, the axial ends of the first walls are displaced orthogonally towards the respective second wall.

Preferably, the axial ends of the first walls completely cover the axial projection of the respective slit.

Preferably, the support is a rubber ring gasket.

According to a second aspect, the present invention provides a garbage disposal unit connectable to a drain opening of a sink, comprising:

a housing;

a grinding mechanism accommodated within the housing;

a splash guard positioned over the grinding mechanism and covering the drain opening;

the splash guard comprising:

a baffle and a support for the baffle, the baffle comprising:

a membrane;

a number of slits in the membrane, extending from a common point;

a corresponding number of pairs of walls extending downwardly from a lower surface of the membrane, each pair of walls bounding the path of a respective slit and forming a channel therebetween;

wherein a first wall of each pair of walls has an axial end displaced laterally towards the second wall of the pair of walls and forming a bottom to the respective channel, and the second wall of each pair of walls terminating before reaching the displaced axial end of the first wall thus forming a lateral opening at the bottom of the channel.

Preferably, the splash guard is integrally formed with a gasket for sealing the housing of the disposal unit to the drain opening Preferably, the baffle is formed of rubber or of a resiliently flexible material.

The foregoing and other aspects will become apparent from the following detailed description of the preferred embodiment when considered in conjunction with the accompanying drawings. The description is given by way of example only.

DETAILED DESCRIPTION OF THE PREFERRED EMBODIMENT

In the following description, in the interest of clarity, not all features of implementation are described. Such features may well need to be adapted to suit particular applications and are well known, form no part of the invention and can be understood from the incorporated references.

Figure 1:
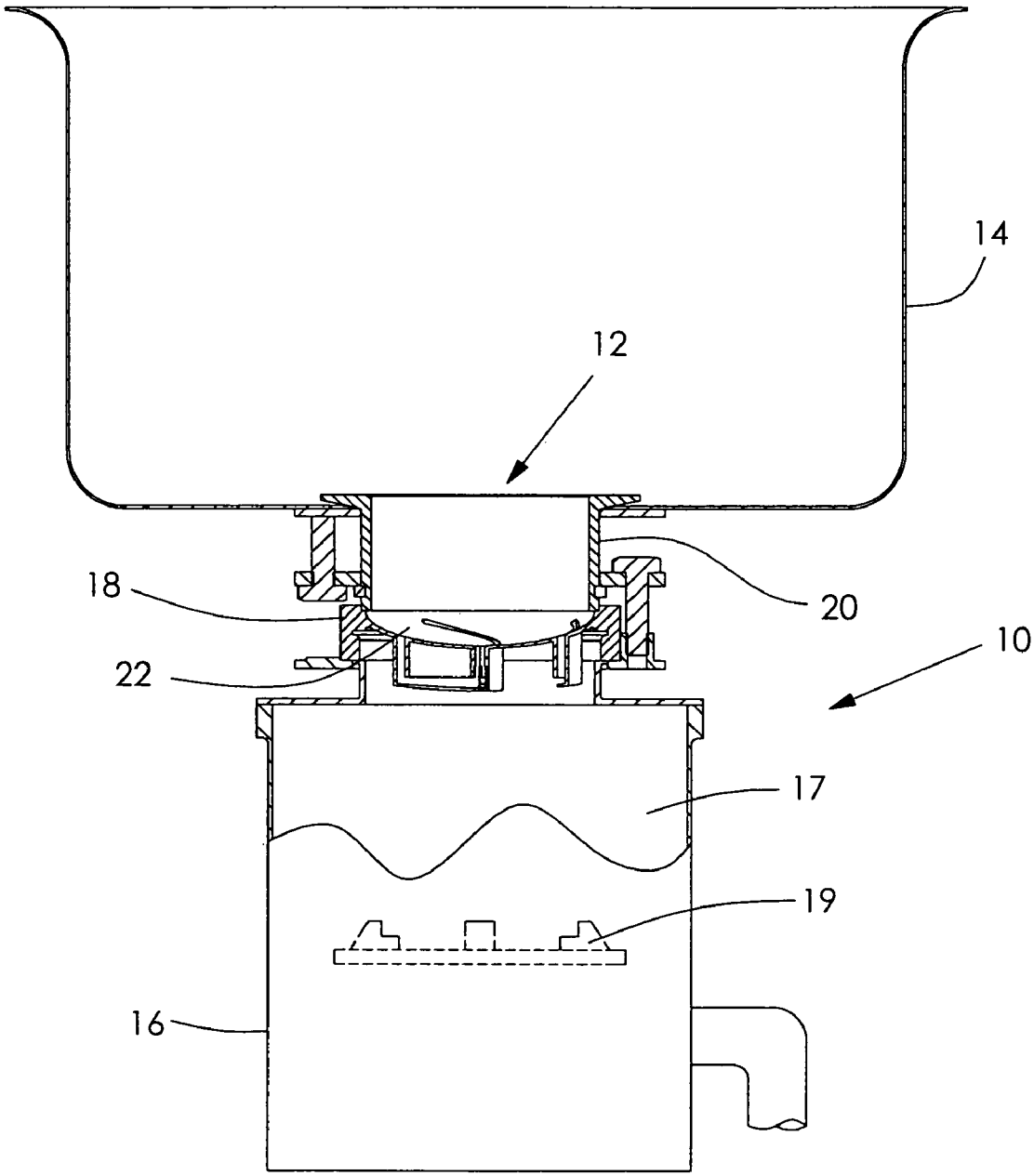
FIG. 1 is a cross-sectional view of the top part of a garbage disposal unit connected to a sink.
Figure 2:
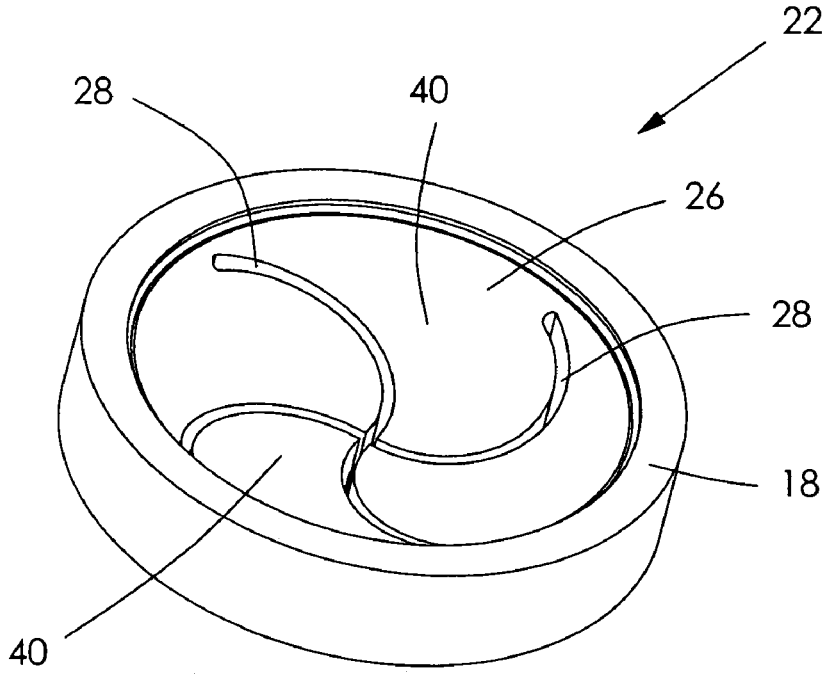
FIG. 2 is a perspective view of a splash guard being a part of the garbage disposal unit of FIG. 1.
Figure 4:
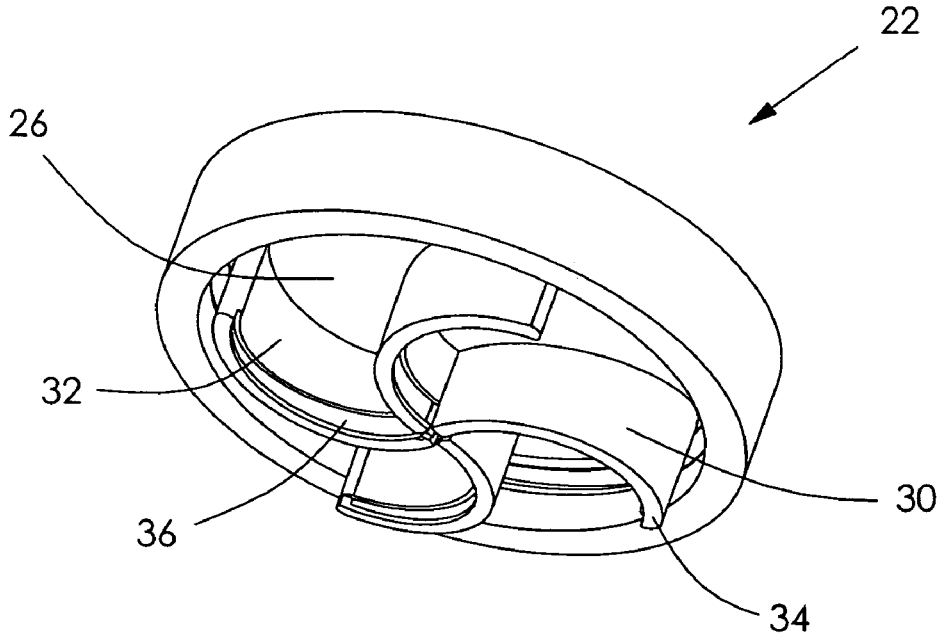
FIG. 4 is a rear perspective view of a splash guard of FIG. 2.
Figure 3:
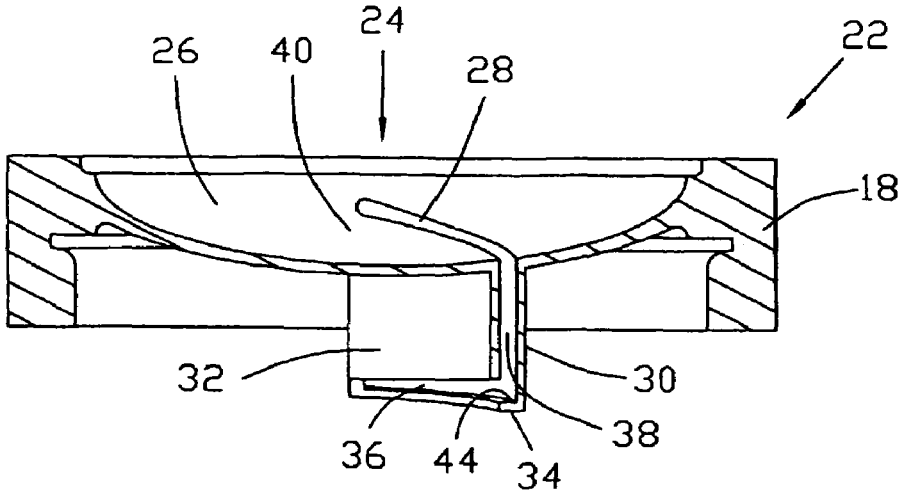
FIG. 3 is a sectional view of the splash guard of FIG. 2.

In FIG. 1, a garbage disposal unit 10 is shown, attached to a drain outlet 12 of a sink 14. A portion of the top of the unit 10 is shown in section to illustrate the attachment method. The disposal unit has a housing 16 accommodating an electric motor driving a grinding mechanism 19 within a grinding chamber 17. The actual attachment is conventional and will not be described in detail suffice to say that the housing 16 of the disposal unit is fitted to rubber gasket 18 which mates with the drain pipe 20 from the sink 14, which in turn is connected to the sink 14 in a water tight manner. The gasket 18 forms a water tight seal between the housing 16 and the drain pipe 20.

The gasket 18 is a ring formed as an integral part of a splash guard 22. Thus placing the splash guard 22 above the grinding mechanism. A baffle 24 having a membrane 26 of rubber extends across and substantially closes the open center of the gasket 18. In this manner, the gasket 18 supports the baffle 24. The membrane 26 has four slits 28, each starting from the center and ending near the outer edge of the membrane 26 along a part circular path, such that in plan view, the four slits 28 form four semicircles equicircumferentially spaced and joining together at the center of the gasket 18. The membrane 26 is also dished to drain water, under the influence of gravity, towards the center.

Each slit 28, is bounded by a pair of walls 30, 32 extending downwardly from the lower surface of the membrane 26. Wall 30 has a greater height in the axial direction of the splash guard 22 than wall 32. The higher wall 30 of each pair has a small flange or ledge 34 in a horizontal direction which extends towards the shorter wall to cover the footprint of the slit 28. Thus the short wall 32 of each pair is spaced from the ledge 34 forming a lateral lower opening 36 to the slit. Thus the slit 28 and walls 30, 32 form a channel 38 with an open top and a lateral or side opening 36 at the bottom. In this way, the openings in the membrane are not clear openings, meaning that the openings do not line up to give a straight line of sight through the baffle.

The slits 28 give the membrane 26 a number of flexible or resilient fingers 40 which can easily flex downwardly to allow the passage of waste matter and water into the disposal unit. The slits allow draining of water from the sink even when the splashguard is in the closed condition. The walls 30, 32 give the membrane 26 shape integrity while being relatively easy to flex downwardly while resisting upward deformation, allowing the membrane 26 to be of relatively thin and resiliently flexible material. The preferred material is a rubber material or rubber like material.

Thus, in use, splashed back water or garbage is not able to easily escape through the splash guard 22 as there are no straight line passages. Any splash would be required to bounce off the inside surface of the walls of the channels, significantly reducing its velocity. Moreover, the open side of the channels face the direction of rotation of the grinding mechanism and this significantly reduces the chances of any splash back occurring, as the splash would normally move upwardly with a radial or spiral component in the direction of rotation of the grinding plate and thus, would hit the baffle on the closed side of the channels.

Figure 5:
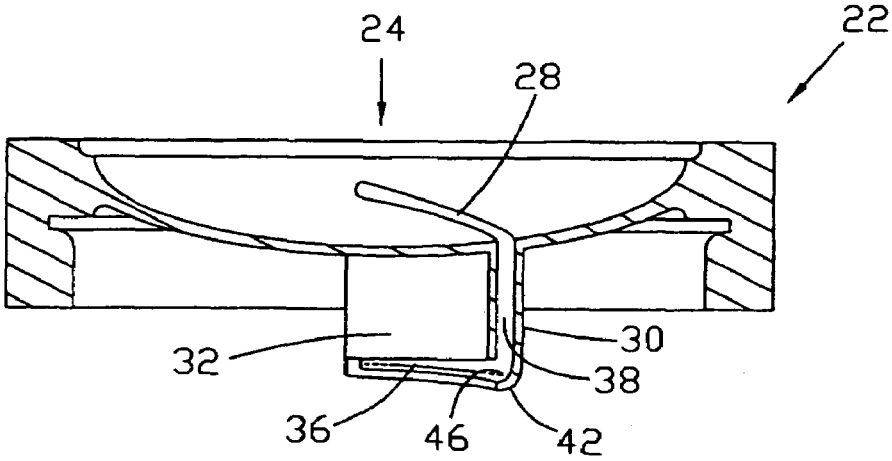
FIG. 5 illustrates a modified splash guard.

FIG. 5 shows an alternative construction of the axial end 42 of the higher wall 30. Instead of a flange or ledge extending orthogonally from the wall, the lower end 42 of the wall 30 is displaced in a smooth manner towards the lower wall 32 or at least towards an axial projection of the lower wall 32 so as to cover or close the axial projection of the slit 28. In this manner the corner 44 between the ledge 34 and the wall 30 is replaced by a smooth curve 46 reducing the possibility of accumulating waste and bacteria and promoting easy cleaning of the baffle 24.

Figure 6:
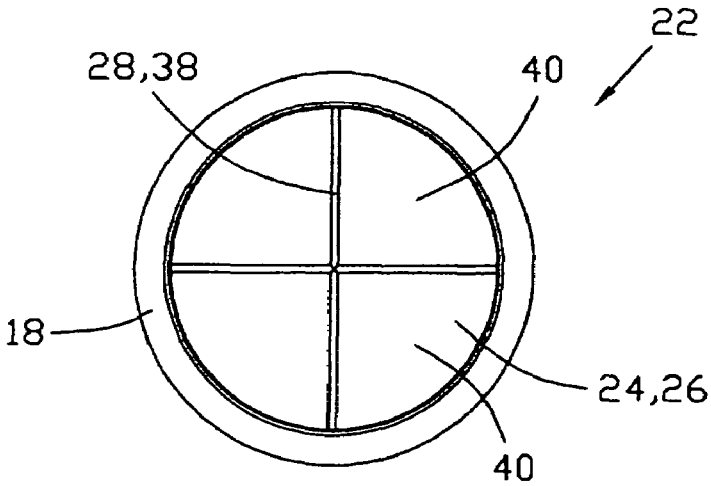
FIG. 6 is a plan view of an alternate splash guard.

FIG. 6 shows in plan view an alternative design, where the slits 28 are radial. The construction of the slits 28, walls 30, 32 and lower openings 36 follows the above explanation. Thus, the actual path of the slits need not be radial straight lines or radial semicircular lines, although it is preferred that the slit paths do have some circumferential component.

The embodiment described above is given by way of example only and various modifications will be apparent to persons skilled in the art without departing from the scope of the invention as defined in the appended claims.

While the preferred embodiment has shown the splash guard as being integral with the mounting gasket, as is know in the prior art, the splash guard could be a separate item fitted to the drain pipe or mouth of the disposal unit and to be readily replaceable by the user. The present invention may be applied to such types of splash guards.

The invention claimed is:

1. A splash guard for a garbage disposal unit, comprising
a baffle and a support for the baffle,
the baffle comprising:
a membrane;
a number of slits in the membrane, extending from a common point;
a corresponding number of pairs of walls extending downwardly from a lower surface of the membrane, each pair of walls bounding the path of a respective slit and forming a channel therebetween;
wherein a first wall of each pair of walls has an axial end displaced laterally towards the second wall of the pair of walls and forming a bottom to the respective channel, and the second wall of each pair of walls terminating before reaching the displaced axial end of the first wall thus forming a lateral opening at the bottom of the channel.

2. The splash guard of claim 1, wherein the slits extend radially across the membrane.

3. The splash guard of claim 1, wherein the slits extend in curvilinear path across the membrane.

4. The splash guard of claim 1, wherein the slits extend in a semicircular path across the membrane.

5. The splash guard of claim 1, wherein the axial ends of the first walls are smoothly displaced towards the respective second wall.

6. The splash guard of claim 1, wherein the axial ends of the first walls are displaced orthogonally towards the respective second wall.

7. The splash guard of claim 1, wherein the axial ends of the first walls completely cover the axial projection of the respective slit.

8. The splash guard of claim 1, wherein the support is a rubber ring gasket.

9. The splash guard of claim 1, wherein the membrane is dished shaped.

10. A garbage disposal unit connectable to a drain opening of a sink, comprising:
a housing;
a grinding mechanism accommodated within the housing;
a splash guard positioned over the grinding mechanism and covering the drain opening;
the splash guard comprising:
a baffle and a support for the baffle, the baffle comprising:
a membrane;
a number of slits in the membrane, extending from a common point;

a corresponding number of pairs of walls extending downwardly from a lower surface of the membrane, each pair of walls bounding the path of a respective slit and forming a channel therebetween;

wherein a first wall of each pair of walls has an axial end displaced laterally towards the second wall of the pair of walls and forming a bottom to the respective channel, and the second wall of each pair of walls terminating before reaching the displaced axial end of the first wall thus forming a lateral opening at the bottom of the channel.

11. The garbage disposal unit of claim 10, wherein the splash guard is integrally formed with a gasket for sealing the housing of the disposal unit to the drain opening.

12. The garbage disposal unit of claim 10, wherein the baffle is formed of rubber.

13. The garbage disposal unit of claim 10, wherein the baffle is formed of a resiliently flexible material.

14. The garbage disposal unit of claim 10, wherein the lateral openings face in the direction of rotation of the grinding mechanism.

* * * * *